US005878460A

United States Patent [19]

Bruce

[11] Patent Number: 5,878,460

[45] Date of Patent: Mar. 9, 1999

[54] GOLF IRON BRUSH

[76] Inventor: Craig Bruce, 7536 Forsyth, Suite 346, Clayton, Mo. 63105

[21] Appl. No.: 2,047

[22] Filed: Dec. 31, 1997

Related U.S. Application Data

[60] Provisional application No. 60/045,611 May 5, 1997.

[51] Int. Cl.[6] ..... A46B 15/00

[52] U.S. Cl. ..... 15/160

[58] Field of Search ..... 15/104.92, 160

[56] References Cited

U.S. PATENT DOCUMENTS

| | | | |
|---|---|---|---|
| D. 278,390 | 4/1985 | Bailey | 15/160 X |
| 2,237,761 | 4/1941 | Leano | 15/160 |
| 2,898,620 | 8/1959 | Dickinson | 15/160 |
| 2,971,499 | 2/1961 | Gardner | 15/160 X |
| 4,380,839 | 4/1983 | Caradonna | 15/104.92 |
| 4,734,953 | 4/1988 | Dodson | 15/106 |
| 4,821,358 | 4/1989 | Wyckoff et al. | 15/104.92 |
| 4,827,555 | 5/1989 | Fruit et al. | 15/160 |
| 5,081,735 | 1/1992 | Wyatt et al. | 15/104.92 |
| 5,094,557 | 3/1992 | Nelson et al. | 15/160 X |
| 5,321,867 | 6/1994 | Probst | 15/160 |

*Primary Examiner*—Mark Spisich
*Attorney, Agent, or Firm*—Robbins & Robbins

[57] ABSTRACT

A golf iron brush designed to clean all golf club irons of loose and embedded debris is provided. The device comprises a housing with top and bottom openings and a front slot extending from top to bottom. The housing has interior opposing brushes which define a central gap through which a golf club iron head is swiped. The housing allows the club head to be passed through, in horizontal alignment of the club shaft, in the direction of the control grooves on the face of the club. This allows the brushes to clean within the grooves for a thorough cleaning.

9 Claims, 7 Drawing Sheets

GOLF IRON BRUSH

CROSS REFERENCE TO RELATED APPLICATION

This application claims the benefit of U.S. Provisional Application No. 60/045,611, filed May 5, 1997.

BACKGROUND OF THE INVENTION

Golf, one of the oldest sports in our country, is played on courses all over the world with very little equipment or rule differences from country to country. There are two types of driving golf clubs, namely irons and woods. The irons, approximately 8–10 per golf set, are the focus of this invention. The typical golfer will utilize his irons whenever he or she needs to move the ball from an area where a golf tee cannot be used, such as on the rough or the fairway. The tee, of course, supports the golf ball and allows a clean ball and club impact without the club head touching the ground. A wood club is typically used for tee shots. With iron shots, where a tee is generally not used, the club head is forced into the grass, soil or sand to contact the ball.

Golf club irons, being numbered in consecutively ascending order up to nine, with an additional wedge, have control grooves disposed on their ball striking face. These grooves, sometimes designed as V-shaped, U-shaped and/or square grooves, play a major roll in ball control. As the club face strikes the ball, these grooves help in grasping, controlling and spinning the ball. Unfortunately, when a good shot is made, a divot (a piece of turf, grass and/or dirt) is often dislodged from the ground by the club, leaving dirt, grass and/or sand in these grooves. If a player continues to play the game without cleaning these grooves and the club face, each and every subsequent shot will be effected by this foreign material. As debris gathers and fills the control grooves on the club, control is soon lost and distance and accuracy will be adversely effected.

Therefore, it is essential that the club head, especially the face and control grooves therein, be cleaned after each shot. In addressing this problem, there have been a number of devices incorporating cleaning brushes to be used on the club heads. Such devices include housings containing brush elements disposed therein which are applied against the club face, or, alternatively, the club head is inserted into the housing and moved back and forth in engagement with the interior brushes. Oftentimes, such housings also contain a cleaning solution which surrounds the brush elements to aid in the cleaning action.

While such devices are relatively effective, they suffer a certain limitation in that the brushing action is typically applied in a transverse direction to the orientation of the control grooves. That is, these types of housings only allow the golf club to be inserted vertically, with the shaft of the club oriented perpendicularly to the plane defining the opening of the housing. The transverse action of the brushes is inadequate to completely remove all debris particles from the innermost corner regions of the control grooves. A parallel brushing action is the only effective way to fully remove the tiny particles from these regions of the control grooves. However, the construction of the prior art housings do not allow for the insertion of the golf club so that the club face will move across the brushes in a parallel direction.

SUMMARY OF THE INVENTION

It is therefore an object of the present invention to provide a golf iron brush cleaning device for effectively removing debris from the control grooves of golf club irons. The device comprises a housing which contains brush elements therein for cleaning the front face, back and bottom of the club head. The housing interior is triangularly shaped to accommodate the full range of club irons which have increasingly greater degrees of pitch of the club face. The brush elements are arranged on the three inner sides of the housing (lateral and rear) with the bristles of the brushes extending into the central interior region of the housing. The brush elements disposed on the respective lateral sides are for engaging the club face and back of the club head, while the brush element disposed on the back side engages the bottom edge of the club head. The bristles of each of the lateral brush elements are arrayed in increasingly greater length from the front to the rear of the housing such that a resulting gap between opposing bristles is maintained. This gap runs between the opposing bristles from the front to the rear of the housing. The gap is preferably no greater than 0.25 inches to allow effective cleaning action when the golf club head is swiped against the brushes. The bristles of the brush element on the back side are of a uniform length.

The housing has top and bottom openings to allow entry and passage through of the golf club head. A longitudinal slot is formed in the front edge of the housing and runs completely from the top to the bottom of the housing which allows the shaft of the club to also pass through. This allows the golf iron head to be inserted and run through the housing such that the bristles engage and run with and parallel to the interior of the control grooves for a more thorough cleaning.

The brush elements are removable from the housing so that cleaning and maintenance can be done periodically. A flexible top cover can be provided on the housing to prevent the brushed off foreign matter from being strewn out of the top of the housing interior while still allowing the club head to pass through. The device can be mounted on a golf bag by use of a clamp or clip.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
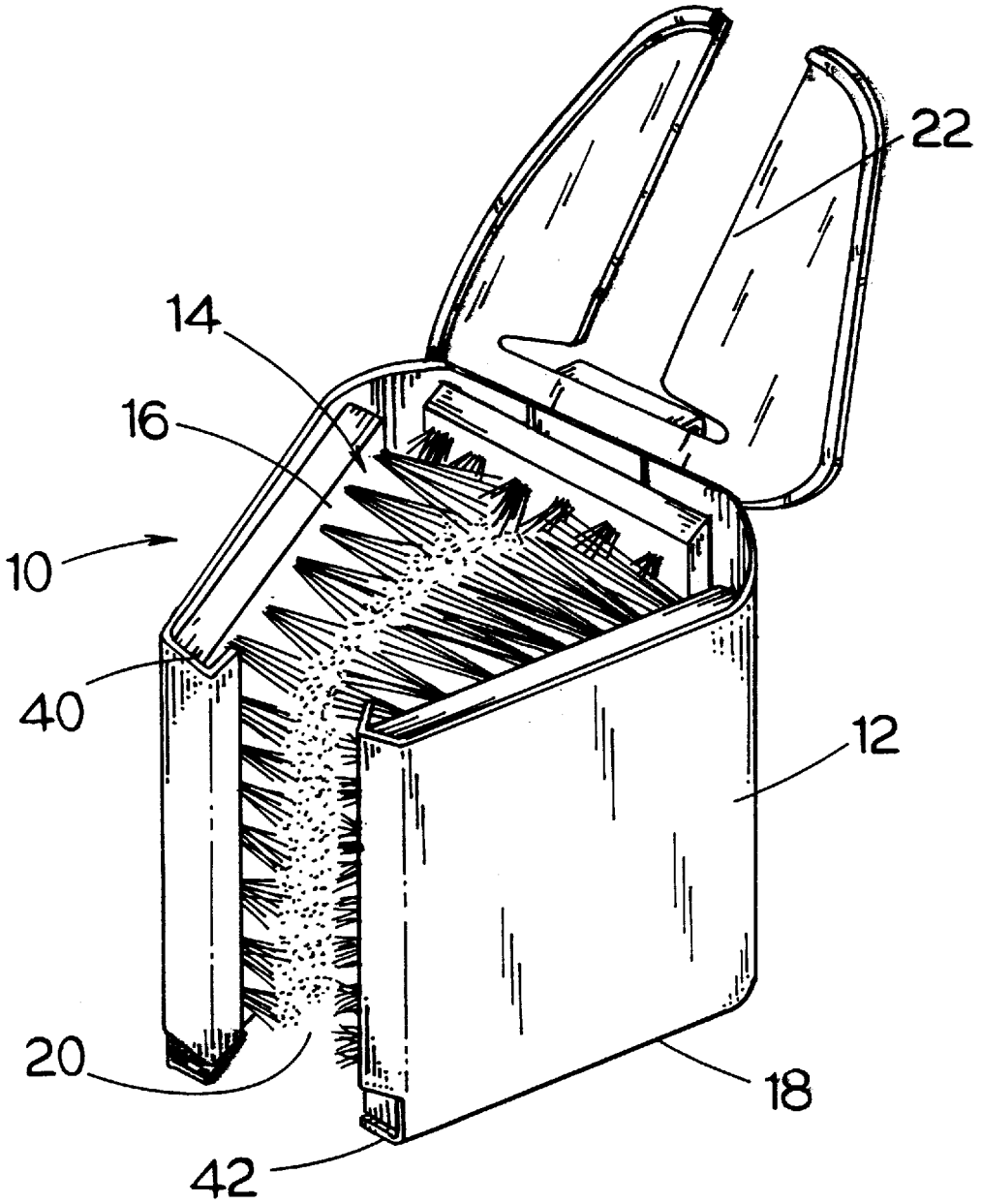
FIG. 1 is a perspective view of the golf iron brush device.
Figure 2:
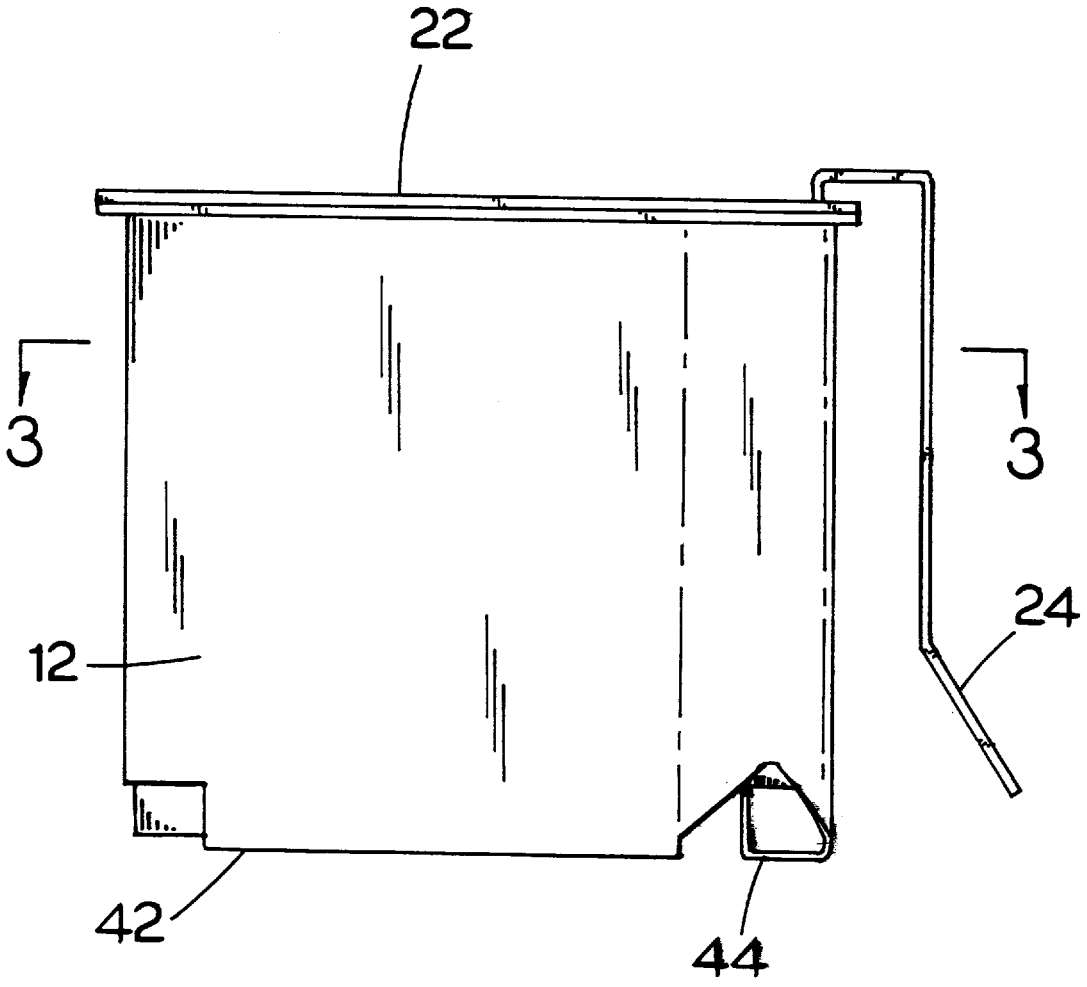
FIG. 2 is a view in side elevation from the side of the device.
Figure 4:
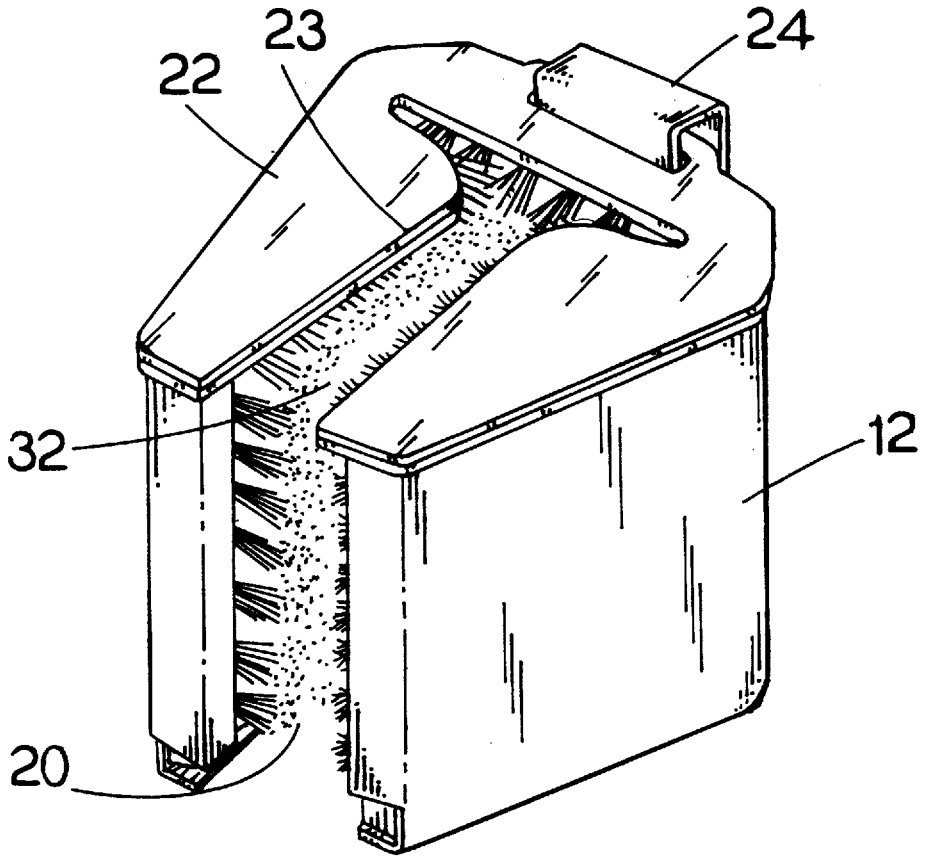
FIG. 4 is a perspective view of the device showing the top lid closed.

The golf iron brush of the present invention is generally indicated by the reference numeral 10 as shown in FIG. 1. It is comprised of a housing 12 in which brush elements 14 are mounted. The housing has a top opening 16 and a bottom opening 18, and a front slot opening 20 which runs from the top to the bottom of the housing as shown in FIG. 1. The housing may be constructed of plastic, stainless steel, aluminum or other suitable material capable of withstanding repeated use. A top cover 22 may be provided to keep brushed off foreign matter from being strewn out of the top of the interior of the housing. The cover may be hinged or otherwise pivotally connected for easy opening and closing, and can also be flexible to permit a golf iron head to pass through when the top cover is in place as shown in FIG. 4. A T-shaped slit opening 23 is provided in cover 22 to allow both right and left-handed club heads to pass through. A clamp or clip 24 as shown in FIG. 2 is provided on the housing to permit attachment over the lip of a golf bag.

Figure 3:
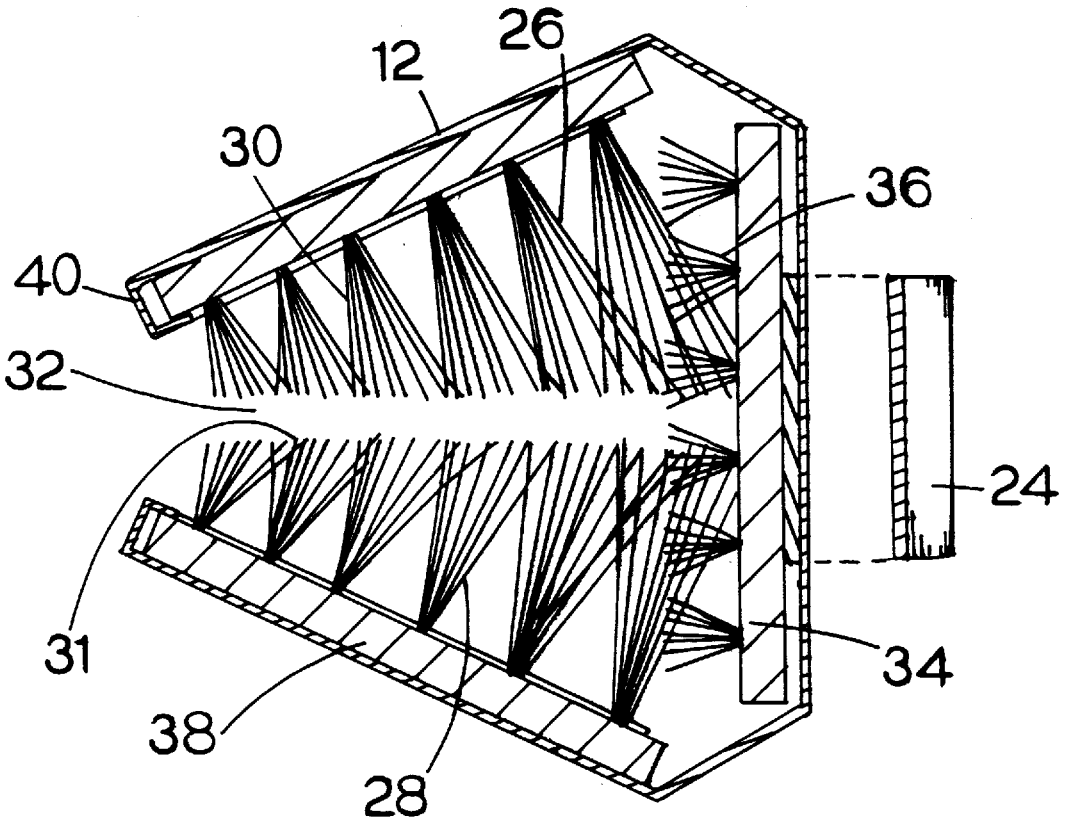
FIG. 3 is a cross sectional view of the device taken along lines 3—3 in FIG. 2.

The brush elements 14 comprise lateral brush blocks 26 and 28 as shown in FIG. 3. They each have a plurality of bristles 30 disposed over their respective surfaces. The number of bristles per block can typically range from 1,200 to 1,500 bristles per brush. Of course, other suitable densities of brushes may also be appropriate. Brush blocks 26 and 28 are positioned along the interior sides of housing 12 so that their opposing bristle ends 31 define a planar gap 32 which bisects the interior space of the housing from top opening 16 to bottom opening 18. This gap space can range between 0.0 to 0.25 inches to allow the iron club head to pass through. The opposing bristle ends should not entangle with each other because it makes passage of the club head difficult and it also hinders the effective cleaning of the grooves. The lengths of the bristles increase from the front of the housing to the rear of the housing. The front, or shortest side, bristles range in length from 0.375 to 0.5 inches; the rear, or longest side, bristles range in length from 1.375 to 1.5 inches. Overall, the bristles of brush blocks 26 and 28 start at around 0.375 inches and increase to around 1.5 inches. Rear brush block 34 is positioned at the back of the housing. It has bristles 36 which substantially cover the rear wall of the housing. Bristles 36 are uniform in length and are around 0.3 inches in height.

For enhanced cleaning effect, the bristles 30 should be oriented in a somewhat rearward angle as shown in FIG. 3. This orientation is most easily constructed by configuring the walls of the housing to approximate a triangular shape. In this manner, the brush blocks can comprise a bristle-anchoring base 38 from which the bristles extend. The bristle anchoring base may comprise a wood, plastic or PVC block to which the bristles are stapled, glued or otherwise attached. The bristles are oriented at a 90° angle from the base; however, due to the effect of the angular walls, the bristles extend rearwardly to about a 45° angle in the housing interior. The bristle ends are cut in uniform, graduated fashion from the front to the rear of the brush block. This effectively creates even-edged walls in gap 32.

Figure 5:
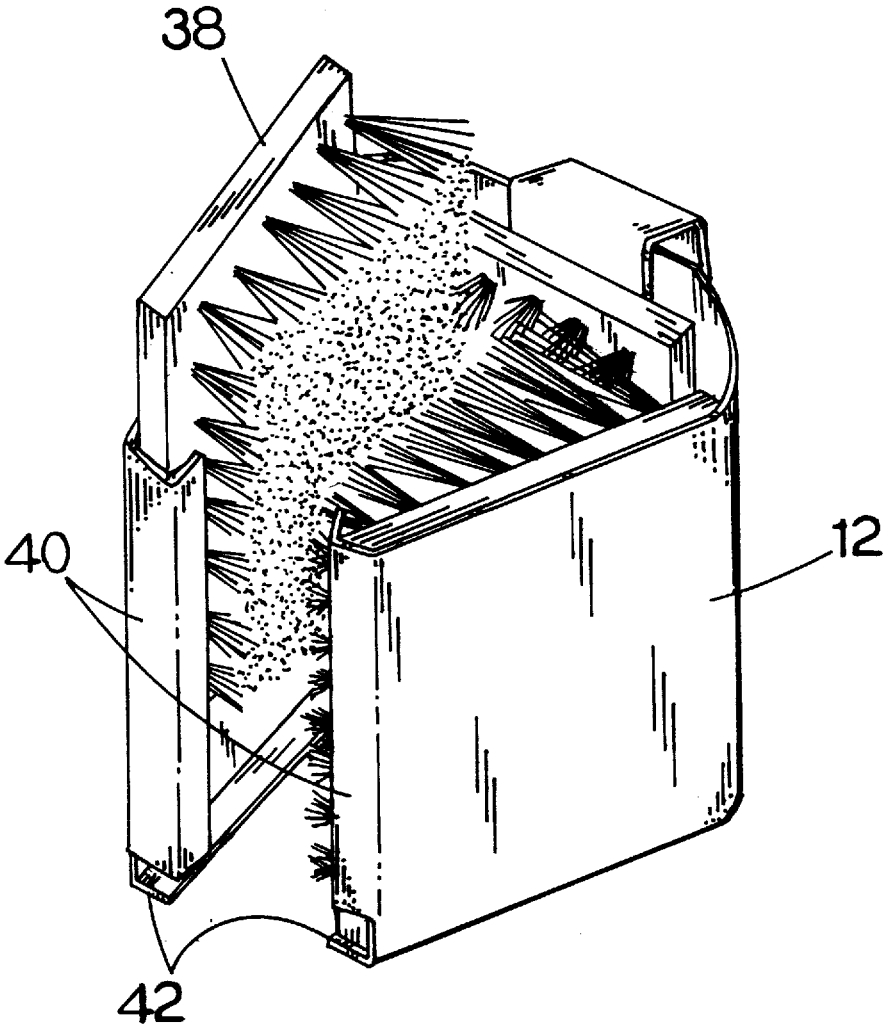
FIG. 5 is a perspective view of the device showing the removable brush blocks.

While the brushes can be permanently mounted within the housing, it is also desirable that the brush blocks be removable for occasional cleaning and replacement. As shown in FIG. 5, the interior wall edges of housing 12 can be provided with retaining brackets which receive the planar bristle bases 38. Side brackets 40 and bottom brackets 42 are provided on the front and bottom edges, respectively, of the housing. A similar bracket 44 disposed along the bottom edge of the rear of housing 12 retains rear brush block 34. To remove a brush block, it is simply lifted from the retaining flanges as shown in FIG. 5.

USE

The inventive golf iron brush cleaner is very simply employed by golfers to easily clean their golf club irons after each shot. The clamp 24 allows the device 10 to be efficiently attached to one's golf bag for easy accessibility, and its light weight and compact size enable it to be a useful accessory without overloading the golf bag. A golf club iron can be easily swept through the device for cleaning while it is attached to the bag.

Figure 6:
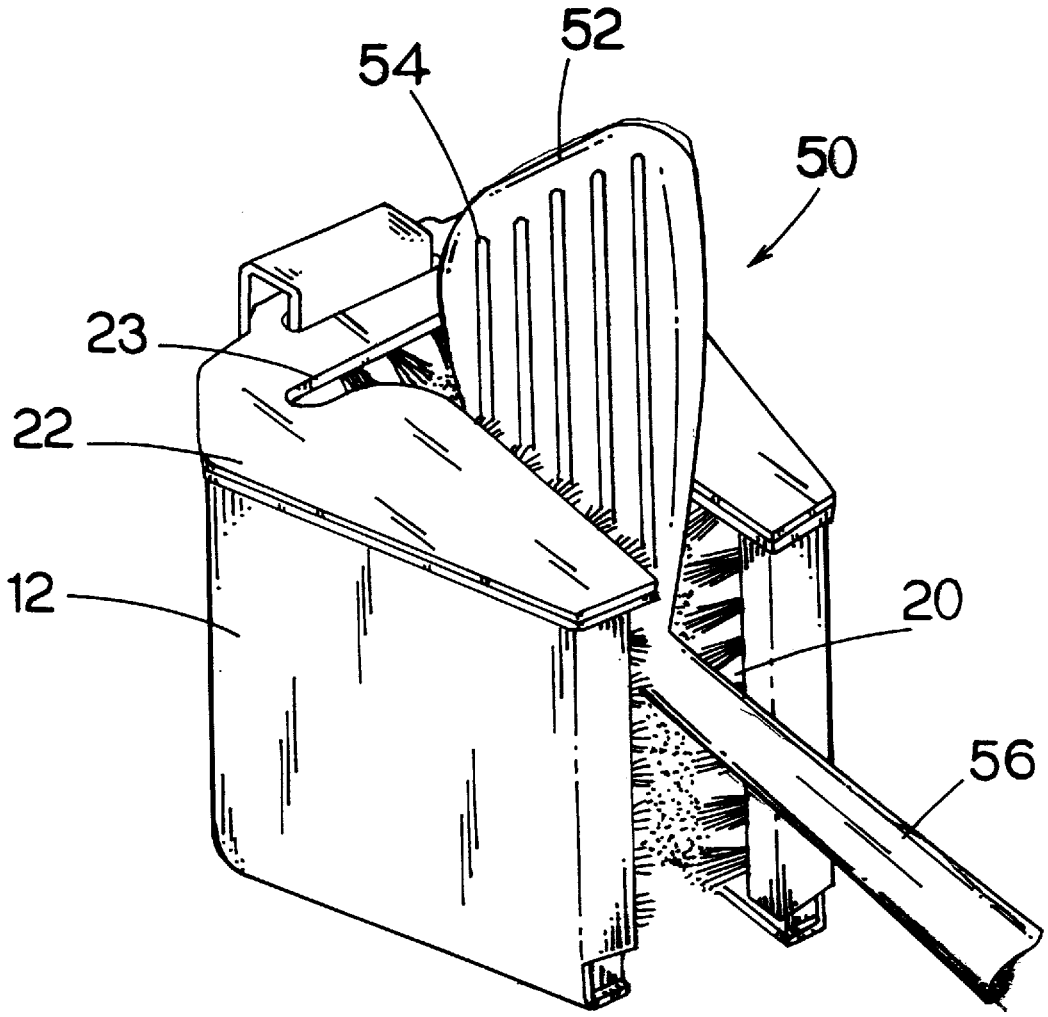
FIG. 6 is a perspective view showing a golf club iron being swept through the device.
Figure 7:
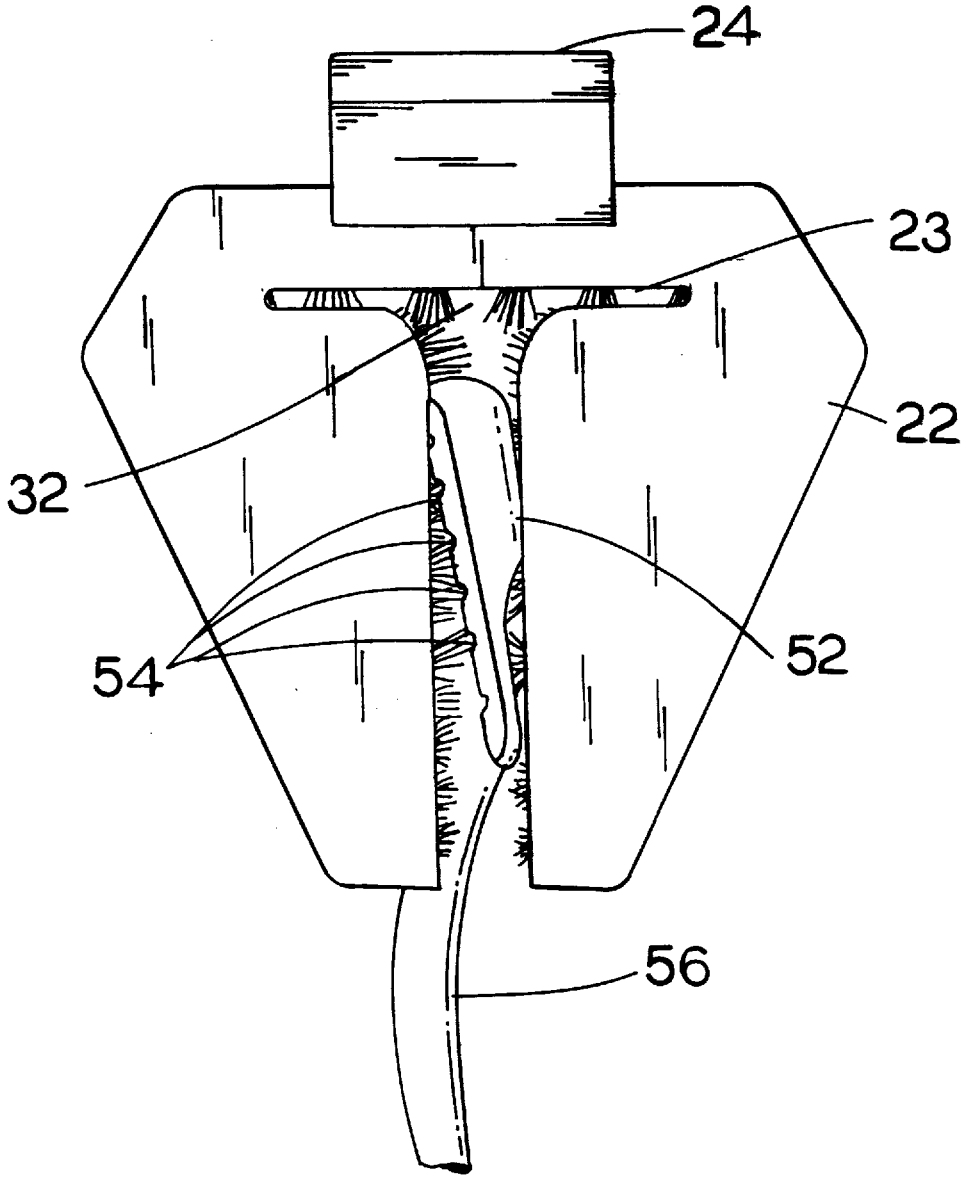
FIG. 7 is a top plan view showing a golf club iron being swept through the device.

FIG. 6 shows a golf club 50 being swept through the device. The club head 52 is introduced into the top opening 16 of the housing so that the control grooves 54 are oriented vertically with respect to the housing. The movement of the club head is in the same direction as that of the control grooves. Top cover 22 is flexible so it may remain in place as the club head passes through its opening 23. The club shaft 56 passes through slot 20, enabling club head 52 to be swiped through the device in a downward, even vertical motion so that the lateral brushes 14 engage and sweep within the control grooves 54 as shown in FIG. 7. This manner of passing the club head through the device avoids a transverse brush action with respect to the control grooves, which can leave a substantial amount of debris in the interstitial corners of the grooves. As the club passes through the housing, the cleaning bristles cross the back, bottom and face of the iron. The club head is swiped through the device and exits the housing through the bottom 18. When the club emerges from the bottom of the housing, the face, bottom and back of the club head will be clean and all loosened debris will fall from the housing to the ground.

The lateral brushes of the device, with their angled and graduated orientation, allow golf club irons of any make and pitch to pass through while receiving a thorough brushing of the entire face and back of the iron. The stiff, straight, short bristles of the rear brush 34 sweep the bottom edge of the club head. Although the device is designed to clean the entire iron, the brushes are oriented in a manner to allow the greatest cleaning on the bottom of the club and the center and bottom of the club face. These areas are of greatest concern to the golfer and collect the greatest amount of loose debris while playing the sport.

It is further contemplated that the brush device might be directed towards specifically cleaning right-handed and left-handed clubs, respectively. In this regard, one of the two lateral brush sides could be designed of different and stiffer bristle material to allow better and more thorough cleaning. These bristles are thicker and stronger than the opposing lateral side brush bristles. This strength is necessary to allow the cleaning of greater angled clubs, such as wedges. These brushes would be designed and constructed for more rigorous brushing because they would be the only bristles which would contact the face of the club and the club face control grooves. The other areas such as the back and bottom of the iron would be cleaned with brushes designed strong enough to clean well but soft enough not to scratch or harm the delicate, more aesthetic areas of the iron. When such brush devices are constructed, it would be necessary to make a right-handed and a left-handed model.

Various changes and modifications may be made within this invention as will be apparent to those skilled in the art. Such changes and modifications are within the scope and teaching of this invention as defined in the claims appended hereto.

What is claimed is:

1. A golf iron cleaning device, said device comprising a housing in which brushes are mounted, said housing having openings at a top and bottom thereof, and having a front slot opening extending from said top and bottom, said brushes comprising a pair of brushes mounted in said housing such that bristle ends of each respective brush oppose each other and define a gap, said gap lying in a plane with said slot opening, said brushes being mounted on sides of said housing and substantially covering said sides, interior faces of said sides of said housing being disposed such that they converge toward one another at said front slot opening to define a triangular area within said housing.

2. The golf iron cleaning device of claim 1 in which said gap comprises a distance ranging up to around 0.25 inches.

3. The golf iron cleaning device of claim 1 in which said bristles of said brushes extend perpendicularly from said interior sides, such that said bristles are disposed at a rearward angle in said triangular area, lengths of said bristles being incrementally increased along said brushes from a forward to a rear portion of said brushes.

4. The golf iron cleaning device of claim 3 in which said incrementally increased lengths of said bristles range from 0.5 inches to 1.5 inches.

5. The golf iron cleaning device of claim 4 in which a back brush is mounted on a rear interior wall of said housing, said back brush having bristles with a length of around 0.3 inches.

6. The golf iron cleaning device of claim 5 in which said gap comprises a distance ranging up to around 0.25 inches, said housing has a top cover, said cover having a top opening in planar alignment with said gap, and said device having means for attaching said housing to an object.

7. The golf iron cleaning device of claim 1 in which said brushes comprise a mounting block to which said bristles are affixed, said housing having means for removably receiving said mounting blocks.

8. The golf iron cleaning device of claim 1 in which a back brush is mounted on a rear interior wall of said housing.

9. The golf iron cleaning device of claim 1 in which said housing has a top cover, said cover having an opening in alignment with said gap.

* * * * *